US006145663A

United States Patent [19]

Kim et al.

[11] Patent Number: 6,145,663

[45] **Date of Patent: *Nov. 14, 2000**

[54] APPARATUS FOR PACKING LIQUID CRYSTAL DISPLAY MODULES

[75] Inventors: Young Su Kim; Sun Im Park, both of Kyungsangbuk-Do, Rep. of Korea

[73] Assignee: LG. Philips LCD Co., Ltd., Seoul, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 09/038,718

[22] Filed: Jan. 28, 1998

[30] Foreign Application Priority Data

Oct. 22, 1997 [KR] Rep. of Korea ..... 97-54107

[51] Int. Cl.[7] ..... B65D 85/48

[52] U.S. Cl. ..... 206/454; 206/592; 206/593; 211/41.1; 220/4.28

[58] Field of Search ..... 206/591, 592, 206/593, 449, 454, 455, 589, 588; 211/41.1, 41.14, 41.18; 118/500; 220/4.16, 4.28, 6

[56] References Cited

U.S. PATENT DOCUMENTS

| | | | |
|---|---|---|---|
| D. 260,237 | 8/1981 | Fuzere | 206/454 |
| 3,133,687 | 5/1964 | Fremion | 206/588 |
| 3,409,202 | 11/1968 | Belcher | 220/4.28 |
| 4,287,990 | 9/1981 | Kurick | 206/448 |
| 4,482,074 | 11/1984 | Lalley | 220/4.28 |
| 5,111,936 | 5/1992 | Kos | 206/454 |
| 5,555,989 | 9/1996 | Moran, Jr. | 220/4.28 |
| 5,588,549 | 12/1996 | Furtner | 220/4.28 |
| 5,704,494 | 1/1998 | Nishikiori et al. | 211/41.12 |
| 5,706,946 | 1/1998 | Kaakizaki et al. | 206/454 |
| 5,816,415 | 10/1998 | Ahn et al. | 211/41.18 |
| 5,855,280 | 1/1999 | Huseman | 211/41.18 |

*Primary Examiner*—Paul T. Sewell
*Assistant Examiner*—Nuan T. Lam

[57] ABSTRACT

A packing apparatus for liquid crystal display modules simplifies a packaging process for packaging liquid crystal display modules and is easily incorporated into an automated manufacturing and packaging line. The packing apparatus includes a body including a receiving space for separately receiving liquid crystal display modules. The body has a structure including a lower plate, a plurality of side walls extending from each side edge of the lower plate and upper plates extending from each upper edge of the side walls. Projection members are provided on the outer surfaces of the body to relieve and absorb an external impact.

18 Claims, 4 Drawing Sheets

APPARATUS FOR PACKING LIQUID CRYSTAL DISPLAY MODULES

BACKGROUND OF THE INVENTION

1. Field of the Invention

This invention relates to an apparatus for packing liquid crystal display modules, and more particularly to a packing apparatus for liquid crystal display modules which simplifies the process of packaging liquid crystal display modules and is easily incorporated into an automated assembly line for manufacturing and packaging liquid crystal display modules.

2. Description of the Related Art

In a process of packaging liquid crystal display modules just manufactured, it is very important to protect each liquid crystal display module from damage which may occur during various operations, such as loading, charging, transport, cargo packing, shipping and the like. Generally, the liquid crystal module is wrapped up in a conventional packing apparatus, which is made from corrugated cardboard material, in order to protect the module. The conventional packing apparatus for liquid crystal display modules includes a plurality of separate parts and components which must be assembled by hand and must be joined together at various stages of the packing process. Accordingly, the conventional packing apparatus has disadvantages in that the assembling process thereof is complicated, and in that the structure and arrangement of the conventional packing apparatus is not sufficient to prevent an impact applied from the outside thereof from damaging the liquid crystal display modules. These disadvantages will be easily understood from the following description with reference to FIG. 1.

FIG. 1 is an exploded perspective view showing a packaging process of liquid crystal display modules using the conventional packing apparatus for the liquid crystal display modules. Referring to FIG. 1, the packing apparatus includes an internal packing frame 6 having receiving spaces defined by a two layer structure which can accommodate two of the liquid crystal display modules 2. The liquid crystal display modules 2 are placed into a shielding bag 4 individually before being put into the packing frame 6. A packing frame 10 is provided with receiving spaces defined by a five layer structure which can receive each of the internal packing frames 6 separately. About five or six of the packing frames 6 can fit within the frame 10.

In a usual packaging procedure of the liquid crystal display modules, the liquid crystal modules 2 are individually put into the shielding bag 4 for the purpose of preventing the occurrence of static electricity. Then, two of the modules 2, each contained in a bag 4, are received into the receiving spaces of the two layer structure provided in the internal packing frame 6. As shown in FIG. 1, the internal packing frame 6 has a two layer structure which is open on its top side thereof, and which has a longitudinal section substantially in the shape of "E" as viewed from the longitudinal sides thereof. Further, the open top side defines an inlet, and the upper portion of the two layer structure is cut away in each upper edge of the right and left side to have the shape " " as shown in FIG. 1.

The internal packing frame 6 is made from corrugated cardboard material. Subsequently, each of the internal packing frames 6 holding two liquid crystal modules 2 are separately inserted into the receiving spaces of the five layer structure provided in the packing frame 10.

The packing frame 10 includes a perpendicular plate 12, hereinafter referred to as a "Y plate", having a cross-section in substantially the shape of a "U", and six horizontal plates 14, hereinafter referred to as "X plates", each spaced a predetermined distance and disposed in parallel at an inner part of the Y plate 12. By such a construction, the receiving spaces of the five layer structure are provided in the packing frame 10. In FIG. 1, the open top side in the packing frame 10 serves to be an inlet for injecting the internal packing frame 6. Further, protrusions 12*a* having a cross-section substantially in the shape of a "U" are defined by the Y plate 12 at the top and bottom portions of the packing frame 10, and wings 14*a* are provided at the same level as each of the X plates 14 at the exterior of the front and rear surface of the packing frame 10. These protrusions 12*a* and wings 14*a* function to relieve an impact from the exterior of the packing apparatus when the packing frame 10 is placed into a box 30. Edge supporting members 16 are provided at the top and bottom surfaces of the packing frame 10 to support left edge portions defined by the protrusions 12*a*, and inserting cuts 14*b* are provided at the right sides of each of the six X plates 14.

Furthermore, as shown in FIG. 1, the packing apparatus includes a plurality of rectangular covers 18 inserted into the inlets in each layer of the packing frame 10, a Z plate 20 to be inserted into the inserting cuts 14*b* defined in the X plates 14, and sheets 22 each inserted into the spaces formed in the top and bottom surfaces of the packing frame 10 to support the protrusions 12*a*. With such a construction, when the internal packing frames 6 receiving two units of the liquid crystal display modules 2 are individually received into five receiving spaces through the inlets of the packing frame 10, the rectangular cover 18 is received into the inlets in each layer. Next, the Z plate 20 having a cross-section substantially in the shape of "U" is inserted into a series of inserting cuts 14*b* defined in the X plates 14. In this case, the length of the Z plate 20 is equal to that of the Y plate 12 including the height of the protrusion 12*a* defined on the top and bottom surfaces of the packing frame 10. Likewise, sheets 22 having a longitudinal section substantially in the shape of a "U" are individually inserted into the spaces formed in the top and bottom surfaces of the packing frame 10. Edge portions in the left side of the sheets 22 are cut away to insert the edge supporting members 16 of the packing frame 10. Finally, the packaging process is completed by putting the packing frame assembled as described above into the box 30.

As described above, in order to protect the module from any exterior impact, the conventional packing apparatus has been used when packaging the liquid crystal display module. However, it is difficult for the above-mentioned packing apparatus to protect the module from the exterior impact safely and reliably because of the structure of the packing apparatus and because the packing apparatus is made from corrugated cardboard material. Also, the conventional packing apparatus has disadvantages in that the complicated structure as shown in FIG. 1 requires an extremely difficult assembly process to be done by hand and in that the assembling procedure thereof is complicated because the plates are separate from each other. Further, the conventional packaging apparatus has disadvantages in that, since it is made from corrugated cardboard material and the plates are separate from each other, alien substances such as dust, particles and the like accumulate in the assembling process of the packing apparatus.

Recently, since the packaging procedure of liquid crystal display modules tends to be automated along with the automation of the production process, it is strongly desired that a packing apparatus for the liquid crystal display modules can be incorporated into an automated assembly line for manufacturing and packaging liquid crystal display modules.

SUMMARY OF THE INVENTION

To overcome the problems described above, the preferred embodiments of the present invention provide a packing apparatus which packages liquid crystal display modules safely and prevents damage to the liquid crystal from being caused by an exterior impact.

The preferred embodiments of the present invention also provide a packing apparatus for liquid crystal display modules which simplifies packaging operations and reduces the time required for packaging liquid crystal modules.

The preferred embodiments of the present invention further provide a packing apparatus for liquid crystal display modules which is adapted for automation of a packaging process.

According to one preferred embodiment of the present invention, a packing apparatus for liquid crystal display modules includes a single unitary body having a lower plate and a plurality of side walls each extending from a respective side edge of the lower plate, each of the side walls including at least one upper plate or cover extending from an upper edge of the respective side wall and being integrally formed with the respective side wall, the body being provided with receiving spaces allowing for insertion of the liquid crystal display modules separately into a respective receiving space, and projection members defined on outer surfaces of the body to relieve an impact from an exterior thereof.

A packing apparatus for liquid crystal display modules according to another preferred embodiment of the present invention includes a single unitary body having a lower plate, a plurality of side walls extending from a respective side edge of the lower plate and each side wall including at least one upper plate extending from a respective upper edge of the side walls and being integrally formed with the side walls, the body being provided with receiving spaces for allowing for insertion of the liquid crystal display modules therein and a plurality of fixing jaws spaced from each other and opposed with respect to each other at the inner surface of the side walls to receive the liquid crystal display modules separately, and protrusions provided at each end of the outermost fixing jaws.

A packing apparatus for liquid crystal display modules according to still another preferred embodiment of the present invention includes a single unitary body having a lower plate, a plurality of side walls extending from a respective side edge of the lower plate, each side wall including at least one upper plate extending from a respective upper edge of the side walls and being integrally formed with the respective side wall, the body being provided with spaces for allowing insertion of the liquid crystal display modules and a plurality of fixing jaws spaced from each other and opposed with respect to each other at an inner surface of the side walls to receive the liquid crystal display modules separately, and protrusions provided in each end of the outermost fixing jaws positioned at edge portions of the side walls to relieve an impact from an exterior thereof.

BRIEF DESCRIPTION OF THE DRAWINGS

These and other objects of the invention will be apparent from the following detailed description of the preferred embodiments of the present invention with reference to the accompanying drawings, in which.

DETAILED DESCRIPTION OF PREFERRED EMBODIMENTS

Figure 2:
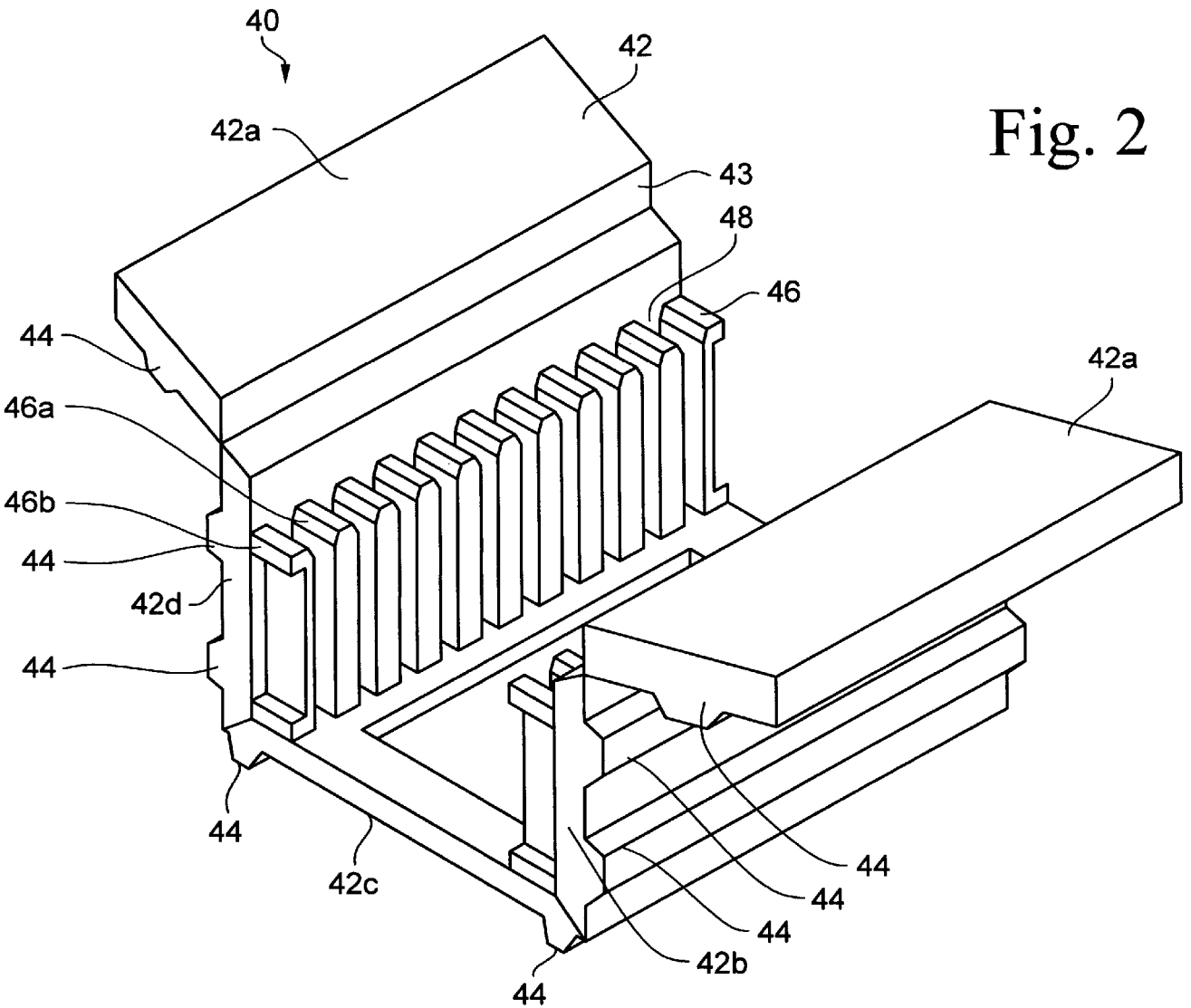
FIG. 2 is a perspective view showing a packing apparatus for liquid crystal display modules according to a preferred embodiment of the present invention.

Referring to FIG. 2, there is shown a packing apparatus 40 for liquid crystal display modules according to a preferred embodiment of the present invention. In FIG. 2, the packing apparatus includes a packing frame 42 having a structure which includes a lower plate 42*c*. The lower plate 42*c* preferably comprises a substantially rectangular frame member with a space defined at a central area thereof.

Side walls 42*b* and 42*d* extend from each side edge of the lower plate 42*c* and the side walls 42*b*, 42*d* are integrally connected to the lower plate 42*c*. Each of the side walls 42*b* and 42*c* includes an upper plate or cover 42*a* arranged to be integral with and extend from each of the upper ends of the side walls 42*b* and 42*d*. The upper plates or covers 42*a* can be folded over and down towards the lower plate 42*c* after the liquid crystal display modules have been inserted into the apparatus 40.

A plurality of projections 44 are preferably provided on the outer surface of the packing frame 42 for absorbing impact applied to the apparatus from an outside thereof. Fixing jaws 46 are disposed on the inner surface of the side walls 42*b* and 42*d* to individually receive and hold the liquid crystal display modules therebetween.

The packing apparatus 40 for liquid crystal display modules shown in FIG. 2 is produced preferably by a metal mold and made from resins such as Expanded Poly Ethylene (EPE), Expanded Poly Propylene or the like. In order to protect the liquid crystal display module from exterior impact, the packing frame 42 includes a lower plate 42*c*, side walls 42*b* and 42*d* extending from side edges of the lower plate 42*c*, and upper plates or covers 42*a* extending from each upper end of the side walls 42*b* and 42*d*. The lower plate 42*c* of the packing frame 42 preferably has a substantially rectangular cut-away portion at the center thereof. When the packing frame 42 is expanded, it has an integral structure in a rectangular shape as seen from the unfolded diagram of the packing apparatus in FIG. 3, and which takes a box shape with four planes by folding four edges thereof.

The packing frame 42 preferably has slant surfaces at the edges or joints of the four planes thereof so that it can be easily folded. In other words, each of the edge portions or interconnected joints of the packing frame has a longitudinal section in the shape of "V" as seen from FIG. 3B. It should be noted from the differences between the state of the apparatus 40 shown in FIG. 2 and that shown in FIG. 3B, the side walls 42*b*, 42*d* are foldably connected to the lower plate 42*c* and the upper plates 42*a* are foldably connected to the respective side walls 42*b*, 42*c*. Thus, the apparatus can easily be transformed from the flat, unfolded state shown in FIG. 3B to the folded state shown in FIG. 2. Further, in the upper plates or covers 42*a* of the packing frame 42, the sum of each width of the two covers 42*a* preferably has a dimension less than or equal to the width of the packing frame 42.

Figure 3:
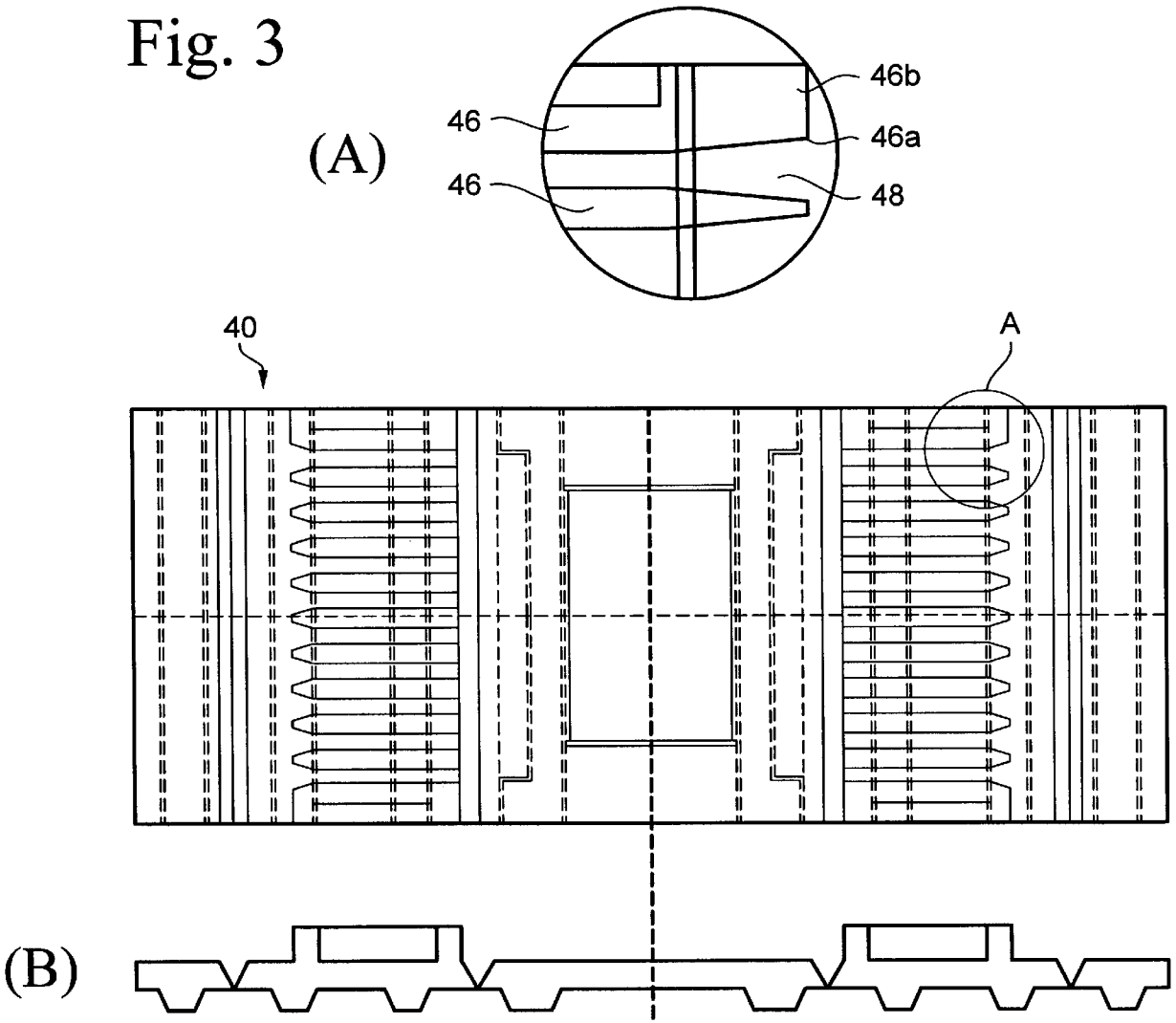
FIG. 3 is a development diagram showing the packing apparatus of FIG. 2.

The projections 44, which are preferably formed by two protruding members disposed on each outer surface of the packing frame 42 along the transversal direction in such a manner that they are spaced by from each other, serve to relieve and absorb the exterior impact applied to the apparatus 40. The projections 44 provided on the lower plate 42 of the packing frame 42 are positioned on each side end of the outer surface of the packing frame 42 and have a cross-section substantially in the shape of a "U" as shown in FIG. 3.

Figure 1:
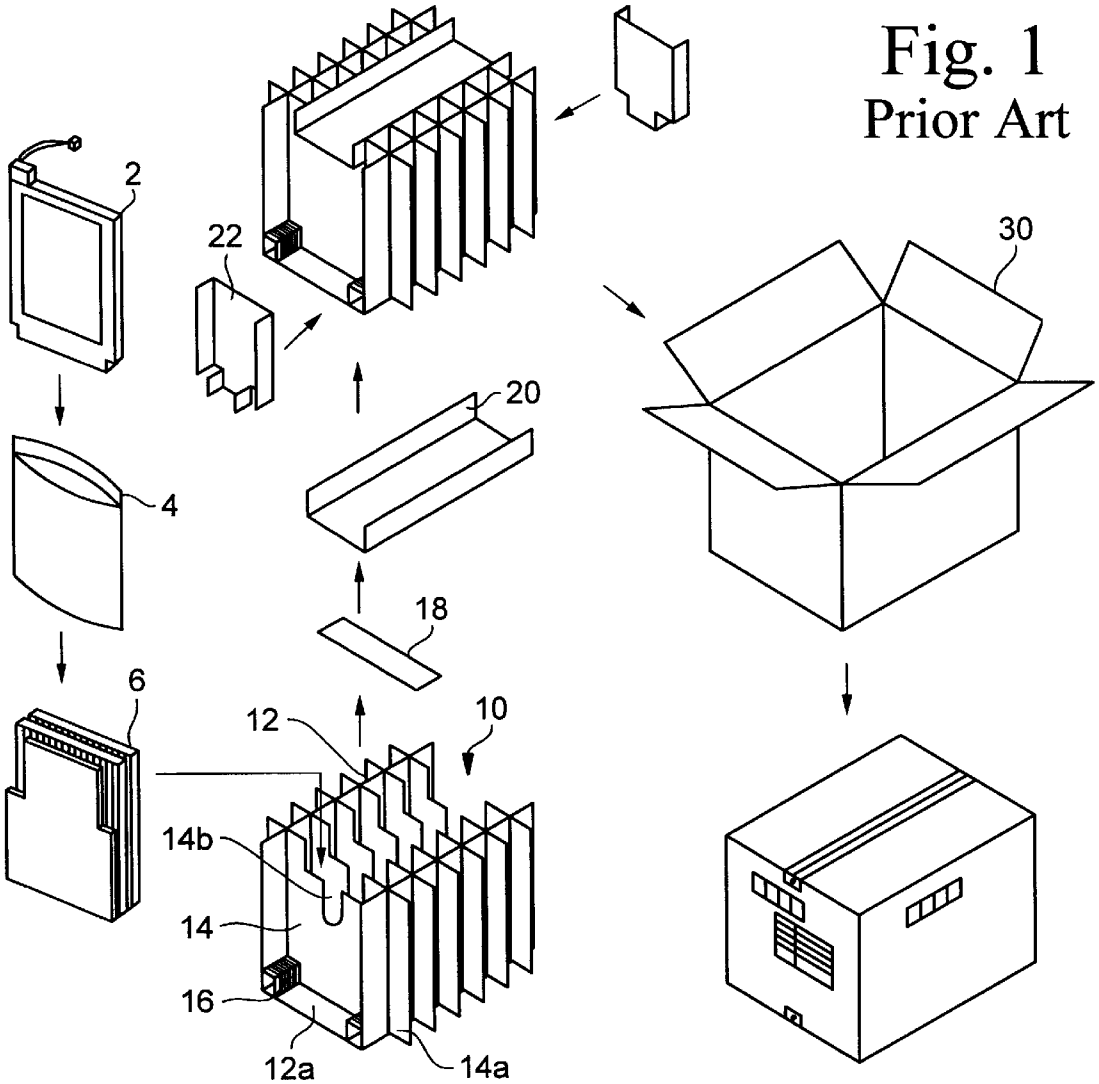
Fig. 1 Prior Art
FIG. 1 is an exploded perspective view showing a packaging procedure of liquid crystal display modules using the conventional packing apparatus for liquid crystal display modules.

The fixing jaws 46 are disposed on each inner surface of the side walls 42*b* and 42*d* of the packing frame 42 in such a manner that they are spaced by a predetermined desired distance therebetween and opposed with respect to each other. In order to insert ten liquid crystal display modules separately, the inner surfaces of the side walls 42*b* and 42*d* of the packing frame 2 are provided with eleven pairs of fixing jaws 46. The number of liquid crystal display modules able to be accommodated in the device 40 and corresponding number of fixing jaws 46 can be varied as needed. The above described structure of the apparatus eliminates the necessity of the additional inner packing frames 6 as shown in FIG. 1, which are required for putting the liquid crystal module thereto in the conventional packing apparatus.

Further, the upper portion of the fixing jaws 46 preferably have slant surfaces 46*a* at each end thereof as shown in detail in FIG. 3A. These slant surfaces define an inlet area 48 for inserting the liquid crystal display module and are provided to insert and draw the liquid crystal display module easily by widening the entrance of the inlet 48. Also, the outer side of two pairs of fixing jaws positioned at the ends of the side walls 42*b* and 42*d* of the packing frame 42 are provided with protrusions 46*b* having a predetermined difference in the level thereof. The two pairs of fixing jaws 46 each have a longitudinal section substantially in the shape of "U", as seen from FIG. 3B, by providing the protrusions 46*b* at the ends of the outermost fixing jaws 46. These protrusions 46*b* prevent a deformation of the packing apparatus 40 and relieve and absorb the exterior impact.

Figure 4:
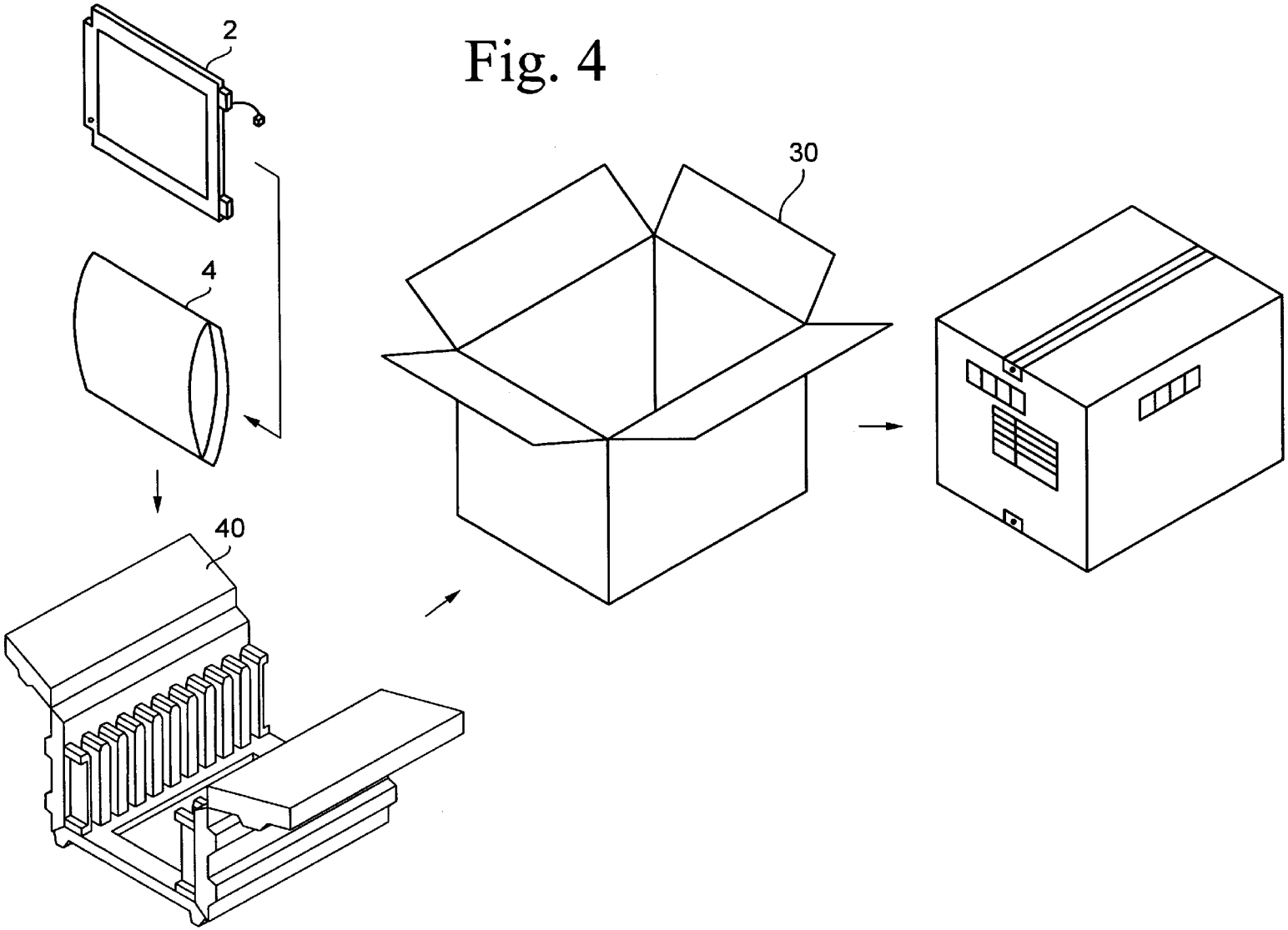
FIG. 4 is an exploded perspective view showing a packaging procedure of the liquid crystal display modules using the packing apparatus in FIG. 2.

FIG. 4 is an exploded perspective view showing a packaging process of the liquid crystal display modules using the packing apparatus 40 according to a preferred embodiment of the present invention. Referring now to FIG. 4, the liquid crystal display module 2 is put into a shielding bag 4 to prevent the occurrence of static electricity, and then the shielding bag 4 holding the liquid crystal display module 2 is separately inserted into a receiving space provided in the packing apparatus 40. After ten or a desired number of liquid crystal display modules 2 are inserted into the packing apparatus 40 in the above manner, the covers or upper plates 42*a* of the packing frame 42 are closed by folding the upper plates 42*a* over and down toward the lower plate 42*c*. Finally, the packing apparatus 40 is put into and wrapped up in the box 30. As a result, by using the integral packing apparatus according to the preferred embodiments of the present invention, a packing apparatus assembling process only requires a single simple folding procedure. Thus, the use of the packing apparatus according to the preferred embodiments of the present invention greatly simplifies the packaging process of the liquid crystal display modules.

As described above, a packing apparatus for the liquid crystal modules according to the preferred embodiments of the present invention is integrally formed and easily transformable to a final form so that packaging of the liquid crystal display modules can be done in a single simple folding procedure. Accordingly, this apparatus can simplify the packaging process and is easily applied to an automation line of the factory where liquid crystal display modules are manufactured and packaged for shipment. Also, the packing apparatus according to the preferred embodiments of the present invention is made from resins and includes the outer projections and the protrusions in the outermost fixing jaws, so that it can protect the liquid crystal display modules contained therein from exterior impact.

Although the present invention has been explained by the preferred embodiments shown in the drawings described above, it should be understood to the ordinary skilled person in the art that the invention is not limited to the preferred embodiments, but rather that various changes or modifications thereof are possible without departing from the spirit of the invention. Accordingly, the scope of the invention shall be determined only by the appended claims and their equivalents.

What is claimed is:

1. A combination comprising:

a plurality of liquid crystal display modules; and a liquid crystal display module packing apparatus having the plurality of liquid crystal display modules packed therein, the liquid crystal display module packing apparatus including:

a single unitary body including a lower plate;

a plurality of side walls each extending from a respective side edge of the lower plate, each of the side walls including at least one upper plate extending from an upper edge of the respective side wall and being integrally formed with the respective side wall;

a plurality of fixing jaws connected to the single unitary body and arranged to define at least one liquid crystal display module holding unit which includes two adjacent fixing jaws for holding one of the plurality of liquid crystal display modules, the two adjacent fixing jaws being spaced from each other by a distance that is slightly greater than a thickness of the liquid crystal display module and is set such that the liquid crystal display module is held in the liquid crystal display module holding unit and contacts the two adjacent fixing jaws of the liquid crystal display holding module; and protrusions extended outwardly from each end of outermost fixing jaws to relieve an impact from the exterior of the packing apparatus.

2. An apparatus as claimed in claim 1, further comprising a plurality of projection members provided on outer surfaces of the body to relieve an impact from an exterior thereof.

3. An apparatus as claimed in claim 1, wherein the fixing jaws are opposed with respect to each other at an inner surface of the side walls to receive the liquid crystal display modules.

4. An apparatus as claimed in claim 3, wherein the upper portions of said fixing jaws have slant surfaces at each side thereof.

5. An apparatus as claimed in claim 1, wherein said packing apparatus is made from resin.

6. An apparatus as claimed in claim 1, wherein the side plates are foldably connected to the lower plate.

7. An apparatus as claimed in claim 1, wherein the upper plates are foldably connected to a respective one of the side plates.

8. An apparatus as claimed in claim 1, wherein the lower plate comprises a substantially rectangular frame element having an opening at a central portion thereof.

9. A combination comprising:

a plurality of liquid crystal display modules; and a liquid crystal display module packing apparatus having the plurality of liquid crystal display modules packed therein, the liquid crystal display module packing apparatus including:

a single unitary body including a lower plate;

a plurality of side walls each extending from a respective side edge of the lower plate, each side wall including at least one upper plate extending from a respective upper edge of the side walls and being integrally formed with the respective side walls;

a plurality of fixing jaws connected to the single unitary body and spaced apart from each other by a distance that is greater than a thickness of each of the liquid crystal display modules and arranged such that each of the liquid crystal display modules are in contact with two of the fixing jaws; and protrusions extended outwardly from ends of the outermost fixing jaws to relieve an impact from the exterior of the packing apparatus.

10. An apparatus as claimed in claim 9, further comprising projection members provided on outer surfaces of said body to relieve exterior impact.

11. An apparatus as claimed in claim 9, wherein said packing apparatus is made from resin.

12. An apparatus as claimed in claim 9, wherein the side plates are foldably connected to the lower plate.

13. An apparatus as claimed in claim 9, wherein the upper plates are foldably connected to a respective one of the side plates.

14. An apparatus as claimed in claim 9, wherein the lower plate comprises a substantially rectangular frame element having an opening at a central portion thereof.

15. A combination comprising:

a plurality of liquid crystal display modules; and a liquid crystal display module packing apparatus having the plurality of liquid crystal display modules packed therein, the liquid crystal display module packing apparatus including:

a single unitary body including a lower plate;

a plurality of side walls each extending from a respective side edge of the lower plate, each side wall including at least one upper plate extending from a respective upper edge of the side walls and being integrally formed with the respective side wall;

a plurality of fixing jaws connected to the single unitary body and arranged to be spaced apart from each other such that an adjacent pair of the fixing jaws contact a portion of opposite major surfaces of one of the liquid crystal display modules such that the liquid crystal display module is held in between the adjacent pair of fixing jaws; and protrusions extended outwardly from ends of the outermost fixing jaws positioned at end portions of the side walls to relieve an impact from the exterior of the packing apparatus.

16. An apparatus as claimed in claim 15, further comprising projection members defined on outer surfaces of said body to relieve exterior impact.

17. An apparatus as claimed in claim 15, wherein the upper portion of said fixing jaws has slant surfaces at each side thereof.

18. An apparatus as claimed in claim 15, wherein said packing apparatus is made from resin.

* * * * *